US006959501B1

(12) United States Patent
Melzer

(10) Patent No.: US 6,959,501 B1
(45) Date of Patent: Nov. 1, 2005

(54) HAIR STYLING VACUUM DEVICE

(76) Inventor: Patricia Melzer, 1906 Rambling Ridge La. #102, Baltimore, MD (US) 21209

( * ) Notice: Subject to any disclaimer, the term of this patent is extended or adjusted under 35 U.S.C. 154(b) by 46 days.

(21) Appl. No.: 10/789,717

(22) Filed: Feb. 27, 2004

(51) Int. Cl.[7] ..... F26B 13/30
(52) U.S. Cl. ..... 34/92; 34/96
(58) Field of Search ..... 34/283, 453, 92, 34/96, 97, 192, 101, 272

(56) References Cited

U.S. PATENT DOCUMENTS 2,503,113 A * 4/1950 Hribar ..... 34/80
3,972,126 A * 8/1976 DeMuro et al. ..... 34/283
5,203,357 A * 4/1993 Vigliotti ..... 132/210
5,267,372 A 12/1993 Jones
5,924,215 A 7/1999 Goodsell
6,293,030 B1 * 9/2001 McCurtis et al. ..... 34/96
6,434,855 B1 8/2002 Miller

* cited by examiner

*Primary Examiner*—Kenneth Rinehart

(57) ABSTRACT

A hair styling vacuum device for removing a liquid from hair wrapped around a curler. The device includes a vacuum assembly and a suction nozzle member. The vacuum assembly includes a housing which defines an interior space. The vacuum assembly includes a motor assembly positioned within the interior space, a vent portion extending trough a perimeter wall of the housing, a filter member and a reservoir member. The housing includes a spout portion in environmental communication with the reservoir member. Preferably, the filter member is positioned between the spout portion and the reservoir portion. The suction nozzle member is operationally coupleable to the spout portion. The suction nozzle is positionable around a curler to facilitate suction from the motor assembly being directed around the curler.

19 Claims, 4 Drawing Sheets

HAIR STYLING VACUUM DEVICE

BACKGROUND OF THE INVENTION

1. Field of the Invention

The present invention relates to hair vacuum and suction devices and more particularly pertains to a new hair styling vacuum device for removing liquid from hair wrapped around a curler.

2. Description of the Prior Art

The use of hair vacuum and suction devices is known in the prior art. Illustrative examples include: U.S. Pat. No. 5,267,372; U.S. Pat. No. 5,924,215; and U.S. Pat. No. 6,434,855.

While these devices fulfill their respective, particular objectives and requirements, the need remains for a device that has a suction nozzle specifically tailored to fir over various size curlers for quickly removing water from the hair wrapped around the curler.

SUMMARY OF THE INVENTION

While there is little dispute that a career as a barber or hairstylist can be both lucrative and fun, there are those tasks related to styling hair which can be less than enjoyable for both the stylist and the client. Specifically, the task of drying a client's hair during a routine permanent can be both daunting and exhausting. When a stylist perms a client's hair, the hair is tightly rolled in specially designed curlers and the permanent solution is readily applied. Once the solution has set on the hair, the stylist must rinse thoroughly dry hair, before the curlers are removed. In order to dry the hair without removing the curlers, the stylist must utilize a towel and actually "blot" the hair dry. A time consuming process, blotting the hair can take several minutes and can be physically taxing for the stylist,—as this process requires them to tightly squeeze each roller with the towel in order to absorb all of the water. For the client, this process can be extremely painful, as squeezing the curlers in this manner tends to pull the hair. Further, the repeated action of the hair being squeezed against the spiky curlers can actually damage the hair. As the perming solution tends to make the hair very fragile and soft, the process of blotting the hair can cause breakage and split ends.

The present invention provides a practical solution to the aforementioned problems. The present invention is a specially designed "wet vacuum" configured specifically to pull moisture and water from hair. A standard wet vac is a vacuum cleaner which operates via an internally contained motor, which, when activated provides ample suction action to quickly remove liquid spills, dirt and debris from carpeting and flooring. This collected water and debris then passes through a filter and is deposited into an internally contained reservoir which can be emptied on demand. As with a traditional wet vac, the vacuum portion of the present invention would operate in a similar manner, via an internally contained motor and suction system. Additionally, the invention has an integrated water reservoir which could be configured to be removable, or would feature a simple drainage plug to empty the unit. The device could be manufactured of heavy duty plastic material and would feature steel and electronic components. For ease of use, this product would feature an integrated "U"-shaped handle, positioned at the top of the unit and designed to afford a stable and steady grip. Most notably, a suction nozzle would be gently contoured to snugly fit over most small, medium and large size perm curlers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
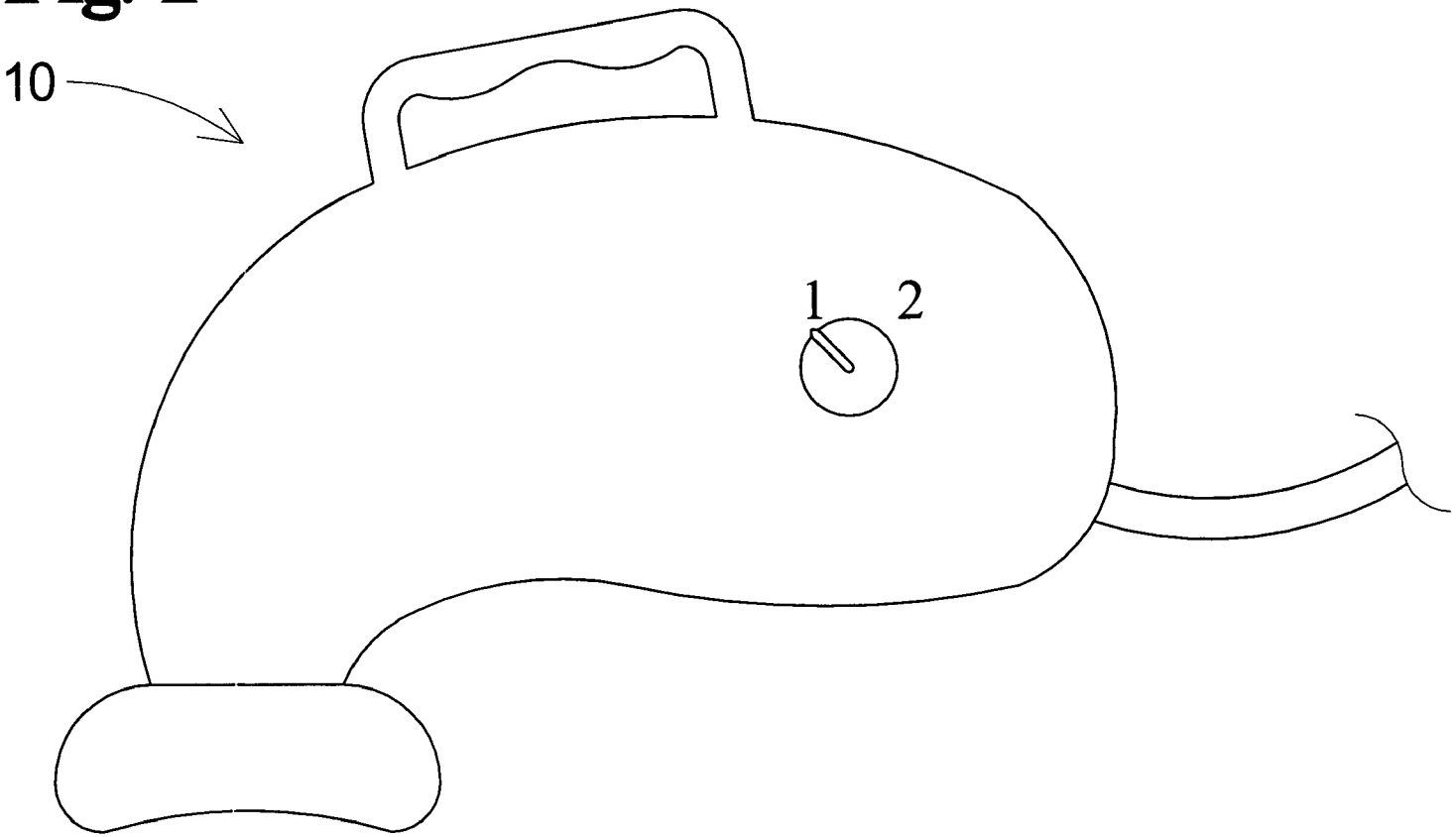
FIG. 1 is a schematic perspective view of a new hair styling vacuum device according to the present invention.
Figure 2:
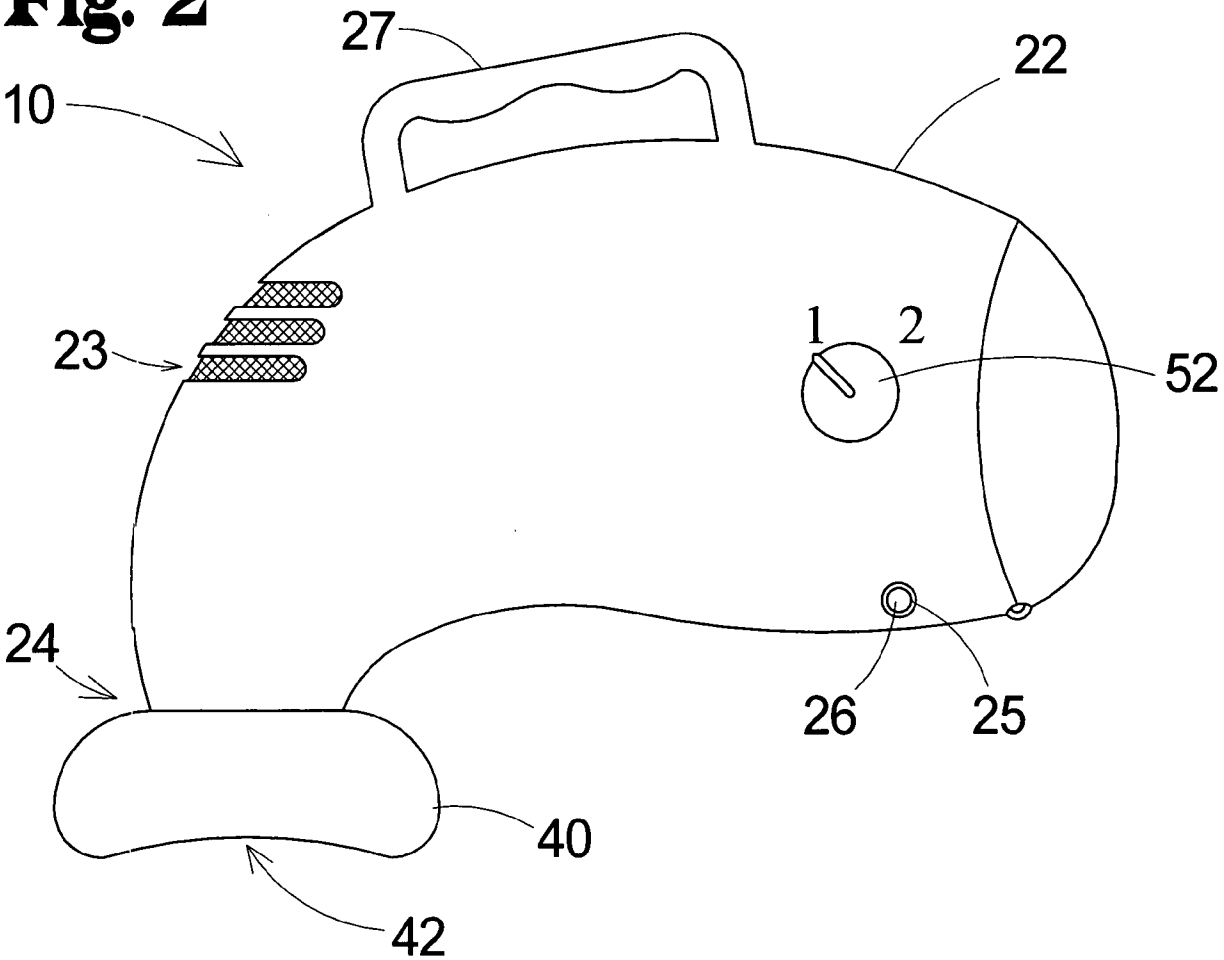
FIG. 2 is a schematic side view of the present invention.
Figure 3:
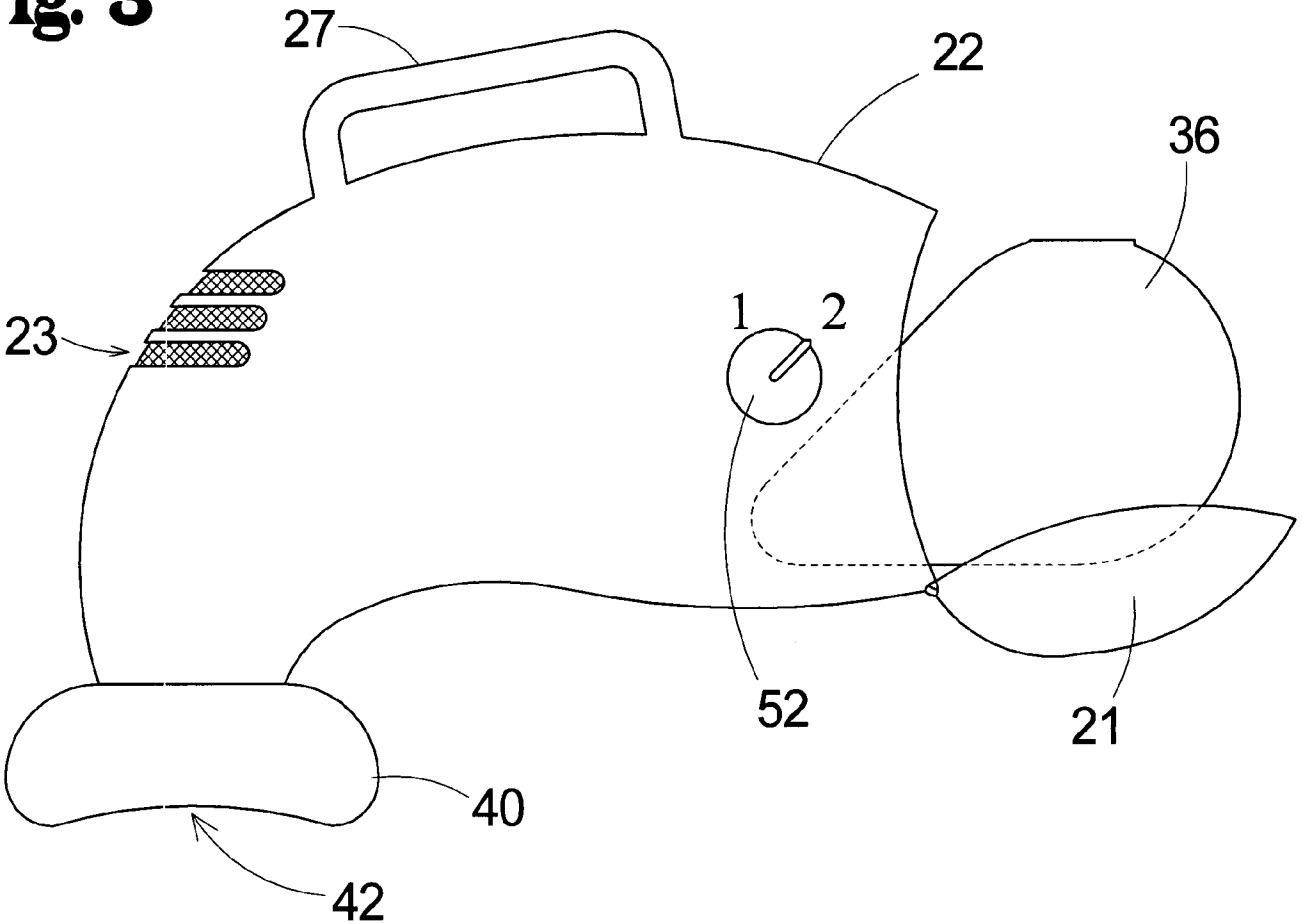
FIG. 3 is a schematic side view of the present invention.
Figure 4:
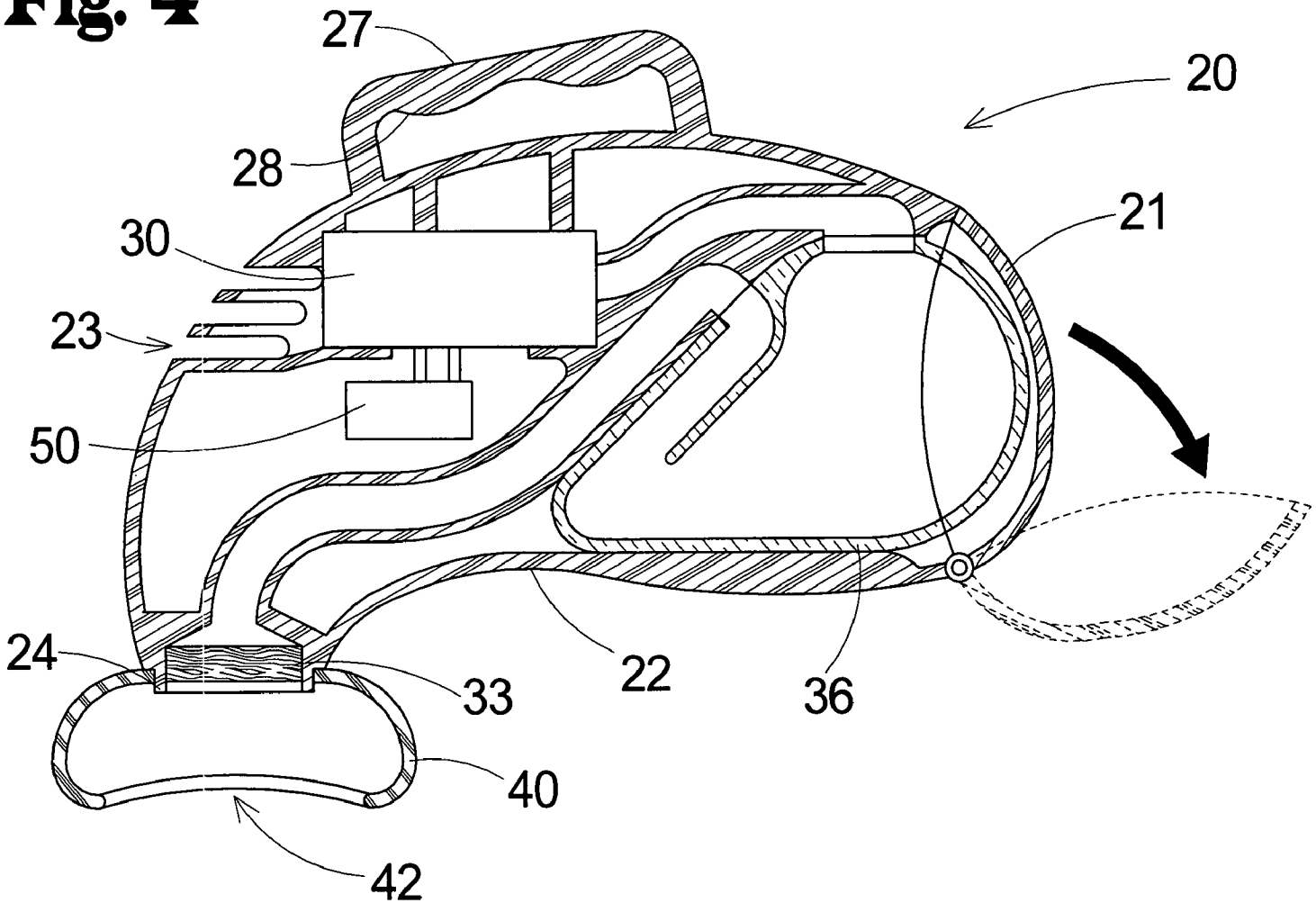
FIG. 4 is a schematic cross-sectional view of the present invention.

With reference now to the drawings, and in particular to FIGS. 1 through 4 thereof, a new hair styling vacuum device embodying the principles and concepts of the present invention and generally designated by the reference numeral 10 will be described.

As best illustrated in FIGS. 1 through 4, the hair styling vacuum device 10 generally comprises a vacuum assembly 20 and a suction nozzle member 40. The vacuum assembly 20 includes a housing 22 which defines an interior space. The vacuum assembly 20 includes a motor assembly 30 positioned within the interior space, a vent portion 23 extending through a perimeter wall of the housing 22, a filter member 33 and a reservoir member 36. The housing 22 includes a spout portion 24 in environmental communication with the reservoir member 36. Preferably, the filter member 33 is positioned between the spout portion 24 and the reservoir member 36.

The suction nozzle member 40 is operationally coupleable to the spout portion 24. The suction nozzle 40 is positionable around a curler to facilitate suction from the motor assembly 30 being directed around the curler.

A handle member 27 may be operationally coupled to the housing 22. The handle member 27 facilitates placement of the suction nozzle 40 adjacent to a desired curler.

In a further embodiment the handle member 27 includes a plurality of finger grooves 28 for facilitating a secure grip around the handle member 27 by a user.

A suction control means 50 may be used to facilitate control of an amount of suction applied to the suction nozzle 40. The suction control means 50 may be operationally coupled to the motor assembly 30 to control an amount of suction developed, or may provide a bleed-off path to divert a portion of the suction away from the spout portion 24.

A suction adjustment member 51 may be positioned on an external portion of the housing 22. The suction adjustment member 51 is operationally coupled to the suction control means 50 and facilitates user adjustment of the suction control means 50.

In a preferred embodiment the suction nozzle member 40 includes an arcuate portion 41 to facilitate concentration of suction around a desired curler.

In a further embodiment the housing 22 further comprises an access panel 21. The access panel 21 facilitates user access to the reservoir member 36. The reservoir member 36 is removable from the housing 22 to facilitate emptying the reservoir member 36.

In another embodiment the housing 22 further comprises a drain portion 25 and a drain plug 26. The drain portion 25 is environmentally coupled to the reservoir member 36. The drain portion 25 extends through a perimeter wall of the housing 22. The drain portion 25 facilitates emptying the reservoir member 36. The drain plug 26 is positionable in the drain portion 25. The drain plug 26 selectively closes the drain portion 25 for maintaining suction for removal of a liquid from hair wrapped around a curler. The drain plug 26 is selectively removable from the drain portion to facilitate emptying the reservoir member 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair styling vacuum device for use with conventional curlers, the device comprising:

a vacuum assembly having a housing defining an interior space, said vacuum assembly having a motor assembly, a vent portion, and a reservoir member, said housing having a spout portion in environmental communication with said reservoir member;

a suction nozzle member operationally coupleable to said spout portion, said suction nozzle being positionable around a curler to facilitate suction from said motor assembly being directed around the curler; and a handle member operationally coupled to said housing, said handle member being adapted for being grasped by a human hand, said handle member facilitating placement of said suction nozzle adjacent to a desired curler.

2. The device of claim 1, wherein said handle member being coupled to a top portion of said housing, said handle member being substantially U-shaped.

3. The device of claim 2, wherein said handle member further comprises plurality of finger grooves for facilitating a secure grip around said handle member.

4. The device of claim 1, wherein said housing further comprises an access panel, said access panel facilitating user access to said reservoir member, said reservoir member being removable from said housing to facilitate emptying said reservoir member.

5. The device of claim 1, wherein said housing further comprises:

a drain portion environmentally coupled to said reservoir member, said drain portion extending through a perimeter wall of said housing, said drain portion facilitating emptying said reservoir member; and a drain plug positionable in said drain portion, said drain plug selectively closing said drain portion for facilitating maintaining suction for removal of a liquid from hair wrapped around a curler, said drain plug being selectively removable from said drain portion to facilitate emptying said reservoir member.

6. The device of claim 1, further comprising a suction control means, said suction control means facilitating control of an amount of suction applied to said suction nozzle.

7. The device of claim 6, further comprising a suction adjustment member positioned on an external portion of said housing, said suction adjustment member being operationally coupled to said suction control means, said suction adjustment member facilitating user adjustment of said suction control means.

8. The device of claim 1, wherein said suction nozzle having an arcuate portion facilitating concentration of suction around a desired curler.

9. The device of claim 1, wherein said suction nozzle has an arcuate portion facilitating concentration of suction around a desired curler.

10. A hair styling vacuum device for use with conventional curlers, the device comprising:

a vacuum assembly having a housing defining an interior space said vacuum assembly having a motor assembly, a vent portion, a filter member, and a reservoir member, said housing having a spout portion in environmental communication with said reservoir member;

a suction nozzle member operationally coupleable to said spout portion, said suction nozzle being positionable around a curler to facilitate suction from said motor assembly being directed around the curler a handle member operationally coupled to said housing, said handle member being adapted for being grasped by a human hand, said handle member facilitating placement of said suction nozzle adjacent to a desired curler;

wherein said handle member being coupled to a top portion of said housing, said handle member being substantially U-shaped;

wherein said handle member further comprises a plurality of finger grooves for facilitating a secure grip around said handle member;

a suction control means, said suction control means facilitating control of an amount of suction applied to said suction nozzle;

a suction adjustment member positioned on an external portion of said housing, said suction adjustment member being operationally coupled to said suction control means, said suction adjustment member facilitating user adjustment of said suction control means;

wherein said suction nozzle having an arcuate portion facilitating concentration of suction around a desired curler.

11. The device of claim 10, wherein said housing further comprises an access panel, said access panel facilitating user access to said reservoir member, said reservoir member being removable from said housing to facilitate emptying said reservoir member.

12. The device of claim 10, wherein said housing further comprises:

a drain portion environmentally coupled to said reservoir member, said drain portion extending through a perimeter wall of said housing, said drain portion facilitating emptying said reservoir member; and a drain plug positionable in said drain portion, said drain plug selectively closing said drain portion for facilitating maintaining suction for removal of a liquid from hair wrapped around a curler, said drain plug being selectively removable from said drain portion to facilitate emptying said reservoir member.

13. A hair styling vacuum device for use with conventional curlers, the device comprising:

a vacuum assembly having a housing defining an interior space, said vacuum assembly having a motor assembly, a vent portion, and a reservoir member, said housing having a spout portion in environmental communication with said reservoir member; and a suction nozzle member operationally coupleable to said spout portion, said suction nozzle being positionable around a curler to facilitate suction from said motor assembly being directed around the curler;

wherein said housing further comprises an access panel, said access panel facilitating user access to said reservoir member, said reservoir member being removable from said housing to facilitate emptying said reservoir member.

14. The device of claim 13 further comprising a handle member operationally coupled to said housing for being grasped by a human hand to facilitate placement of said suction nozzle adjacent to a desired curler.

15. The device of claim 14, wherein said handle member is coupled to a top portion of said housing, said handle member being substantially U-shaped.

16. The device of claim 13, wherein a plurality of finger grooves are formed on said handle member for facilitating a secure grip on said handle member.

17. The device of claim 13, wherein said housing further comprises:

a drain portion for emptying said reservoir member, said drain portion being in fluid communication with said reservoir member, said drain portion extending through a perimeter wall of said housing; and a drain plug positionable in said drain portion, said drain plug being selectively insertable into and removable from said drain portion for closing said drain portion to maintain suction for removal of a liquid from hair wrapped around a curler.

18. The device of claim 13, further comprising a suction control means for controlling of an amount of suction applied to said suction nozzle.

19. The device of claim 18, further comprising a suction adjustment member positioned on an external portion of said housing, said suction adjustment member being operationally coupled to said suction control means, said suction adjustment member facilitating user adjustment of said suction control means.

* * * * *